US008665158B2

(12) United States Patent
Chung et al.

(10) Patent No.: US 8,665,158 B2
(45) Date of Patent: Mar. 4, 2014

(54) PRINTED FILTERING ANTENNA

(75) Inventors: Shyh-Jong Chung, Hsinchu County (TW); Chao-Tang Chuang, Hualien County (TW)

(73) Assignee: National Chiao Tung University, Hsinchu, Taiwan (TW)

( * ) Notice: Subject to any disclaimer, the term of this patent is extended or adjusted under 35 U.S.C. 154(b) by 240 days.

(21) Appl. No.: 13/342,116

(22) Filed: Jan. 2, 2012

(65) Prior Publication Data

US 2013/0049900 A1 Feb. 28, 2013

(30) Foreign Application Priority Data

Aug. 29, 2011 (TW) ..... 100130932 A

(51) Int. Cl.
*H01Q 1/38* (2006.01)

(52) U.S. Cl.
USPC ..... 343/700 MS; 343/722; 343/909; 333/134; 333/204

(58) Field of Classification Search
USPC ..... 343/700 MS, 756, 909; 333/134, 202, 333/204
See application file for complete search history.

(56) References Cited

U.S. PATENT DOCUMENTS 5,045,862 A * 9/1991 Alden et al. ..... 343/700 MS
5,448,255 A * 9/1995 Hulett et al. ..... 343/840
6,147,572 A 11/2000 Kaminski et al.
6,597,259 B1 * 7/2003 Peters ..... 333/134
7,053,845 B1 * 5/2006 Holloway et al. ..... 343/725
8,242,970 B2 * 8/2012 Fukui et al. ..... 343/909
8,471,649 B2 * 6/2013 Devereux et al. ..... 333/134

FOREIGN PATENT DOCUMENTS

| | | |
|---|---|---|
| JP | 04-297104 | 10/1992 |
| JP | 05-145316 | 6/1993 |
| JP | 10-200312 | 7/1998 |
| JP | 2003-258547 | 12/2003 |
| JP | 2008-219519 | 9/2008 |

OTHER PUBLICATIONS

Fully integrated passive front-end solutions for a V-band LTCC wireless system.
Integration of filters and microstrip antennas.
Electrically small superconducting antennas with bandpass filters.

* cited by examiner

*Primary Examiner* — Tho G Phan
(74) *Attorney, Agent, or Firm* — CKC & Partners Co., Ltd.

(57) ABSTRACT

A printed filtering antenna is provided. This filtering antenna comprises an antenna part and a coupled line resonator. The antenna part is directly connected to a coupled line resonator and occupies an antenna area. The coupled line resonator provides a filtering mechanism together with the antenna part. The coupled line resonator comprises a short-circuited stub and an open-circuited stub. The short-circuited stub comprises an open-circuited end and a short-circuited end connected to ground. The open-circuited stub is parallel to the short-circuited stub. The open-circuited stub comprises a first end and a second end. The first end is connected to the feed point and is corresponding to the open-circuited end of the short-circuited stub such that the open-circuited stub is coupled to the short-circuited stub.

13 Claims, 11 Drawing Sheets

PRINTED FILTERING ANTENNA

RELATED APPLICATIONS

This application claims priority to Taiwan Application Serial Number 100130932, filed Aug. 29, 2011, which is herein incorporated by reference.

BACKGROUND

1. Technical Field

The present disclosure relates to an antenna device. More particularly, the present disclosure relates to a printed filtering antenna.

2. Description of Related Art

There are some remarkable aspects to the rapid growth in wireless communications, as typified by the rapid growth in mobile telephony. In a wireless communication system, the antenna plays an important role. A well-designed antenna can deliver and receive a wireless signal within the requested frequency band with good quality, regardless of the location or the orientation of the antenna. In recent years, there has been a trend toward small and simple designs of antennas. Hence, the printed antenna has been popular for various applications due to their low cost, easy fabrication, low profile and compatibility with integrated circuits.

Since it is necessary to process a signal within a specific range of a frequency band, the filter is important to the design of the overall antenna structure. Recently, some technologies propose a filtering antenna in which an antenna is used to replace the last order of the resonator and the resistive load of the filter. However, when the filter and the antenna are integrated together, the overall area of the circuit will increase as well, which runs counter to the design trend described above.

Accordingly, what is needed is a printed filtering antenna to realize a good filtering mechanism while maintaining a smaller size. The present disclosure addresses such a need.

SUMMARY

An aspect of the present disclosure is to provide a printed filtering antenna. The printed filtering antenna comprises an antenna part and a coupled line resonator connected to the antenna part to provide a filtering mechanism together with the antenna part. The coupled line resonator comprises a short-circuited stub and an open-circuited stub. The short-circuited stub comprises an open-circuited end and a short-circuited end connected to ground. The open-circuited stub is parallel to the short-circuited stub. A gap is formed between the open-circuited stub and the short-circuited stub. The open-circuited stub comprises a first end and a second end in which the first end is connected to the antenna part and is corresponding to the open-circuited end of the short-circuited stub such that the open-circuited stub is coupled to the short-circuited stub.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1A:
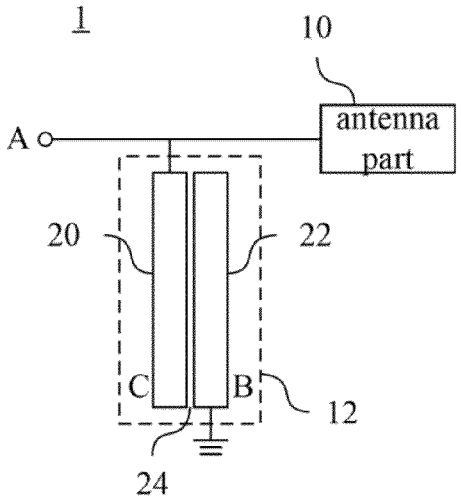
FIG. 1A and FIG. 1B are geometrical diagrams of a printed filtering antenna in two embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1A is a geometrical diagram of a printed filtering antenna 1 in an embodiment of the present disclosure. The printed filtering antenna 1 comprises an antenna part 10 and a coupled line resonator 12.

In different embodiments, the antenna part 10 can be a monopole antenna with a Γ-shape, an F antenna, an inverted-F antenna or another type of antenna. In FIG. 1A, point A is a feed point of the antenna part 10. The coupled line resonator 12 is connected to the antenna part 10 to provide a filtering mechanism together with the antenna part 10. As depicted in FIG. 1A, the coupled line resonator 12 comprises an open-circuited stub 20 and a short-circuited stub 22. In the present embodiment, the printed filtering antenna 1 comprises only one coupled line resonator 12. Consequently, the order of the coupled line resonator 12 is one and the printed filtering antenna 1 is a second-order filtering antenna.

The open-circuited stub 20 of the coupled line resonator 12 comprises a first end and a second end. The first end of the open-circuited stub 20 is connected to point A, i.e., the feed point of the antenna part 10. The second end is depicted as point C in FIG. 1A. A gap 24 is formed between the open-circuited stub 20 and the short-circuited stub 22. That is, the open-circuited stub 20 and the short-circuited stub 22 are parallel to each other and the gap 24 is formed therebetween. The short-circuited stub 22 comprises an open-circuited end and a short-circuited end. The open-circuited end corresponds to the first end of the open-circuited stub 20. The short-circuited end is at point B in FIG. 1A.

Figure 1B:
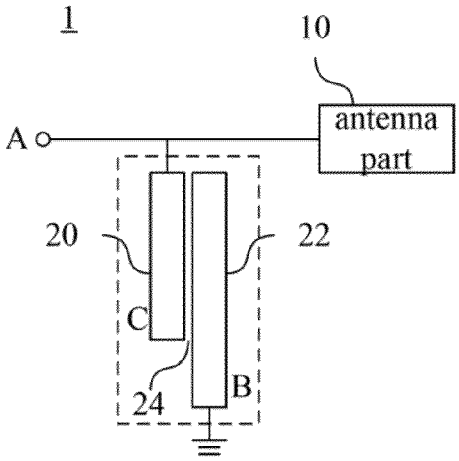

In the present embodiment, a first electric length of the open-circuited stub 20 and a second electric length of the short-circuited stub 22 are equal. In other words, each of the open-circuited stub 20 and the short-circuited stub 22 is a quarter-wavelength circuit. In other embodiments, the open-circuited stub 20 and the short-circuited stub 22 can be designed such that they have unequal lengths as shown in FIG. 1B.

Figure 2A:
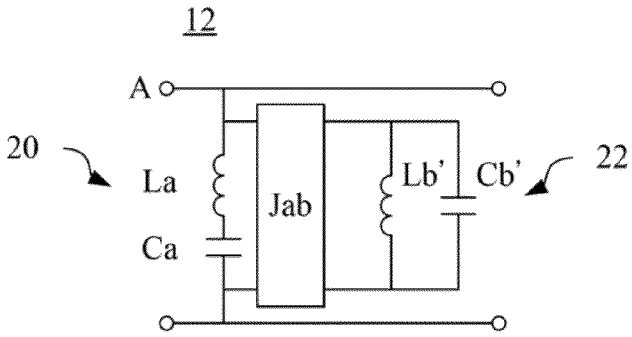
FIG. 2A to FIG. 2C are diagrams of equivalent circuits of an open-circuited stub and a short-circuited stub in an embodiment of the present disclosure.
Figure 2B:
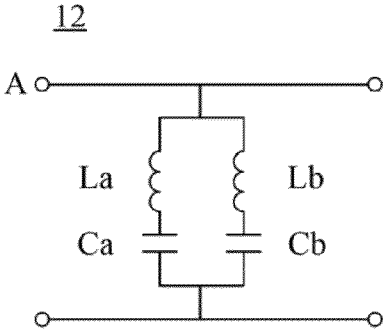
Figure 2C:
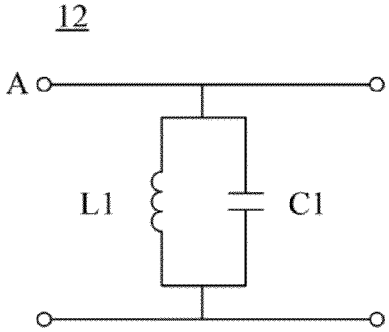

The gap 24 between the open-circuited stub 20 and the short-circuited stub 22 allows the open-circuited stub 20 and the short-circuited stub 22 to be electromagnetically coupled to each other. FIG. 2A to FIG. 2C are diagrams of equivalent circuits of the open-circuited stub 20 and the short-circuited stub 22 in an embodiment of the present disclosure. Taking the open-circuited stub 20 and the short-circuited stub 22 depicted in FIG. 1A that have the same electric length as an example, the equivalent circuit of the open-circuited stub 20 and the short-circuited stub 22 comprises a series-connected inductor-capacitor (LC) resonator La/Ca and a parallel-connected inductor-capacitor (LC) resonator Lb'/Cb'. The gap 24 between the open-circuited stub 20 and the short-circuited stub 22 acts as a J-inverter Jab. Though the open-circuited stub 20 and the short-circuited stub 22 have the same length and the same width, the series-connected LC resonator La/Ca and the parallel-connected LC resonator Lb'/Cb' have different resonant frequencies due to the coupling effect between them.

The equivalent circuit in FIG. 2A can be further transformed into the equivalent circuit in FIG. 2B. The equivalent circuit shown in FIG. 2B comprises two groups of series-connected LC resonators La/Ca and Lb/Cb that are connected in parallel. The series-connected LC resonators La/Ca have a resonant frequency fa and the series-connected LC resonators Lb/Cb have a resonant frequency fb. Consequently, the two groups of series-connected LC resonators La/Ca and Lb/Cb generate two symmetric transmission zeros at a band edge of the printed filtering antenna 1. The equivalent circuit in FIG. 2B can be further transformed into the equivalent circuit in FIG. 2C around the resonant frequency fr, in which the equivalent circuit in FIG. 2C comprises a group of parallel-connected LC resonator L1/C1.

Figure 3:
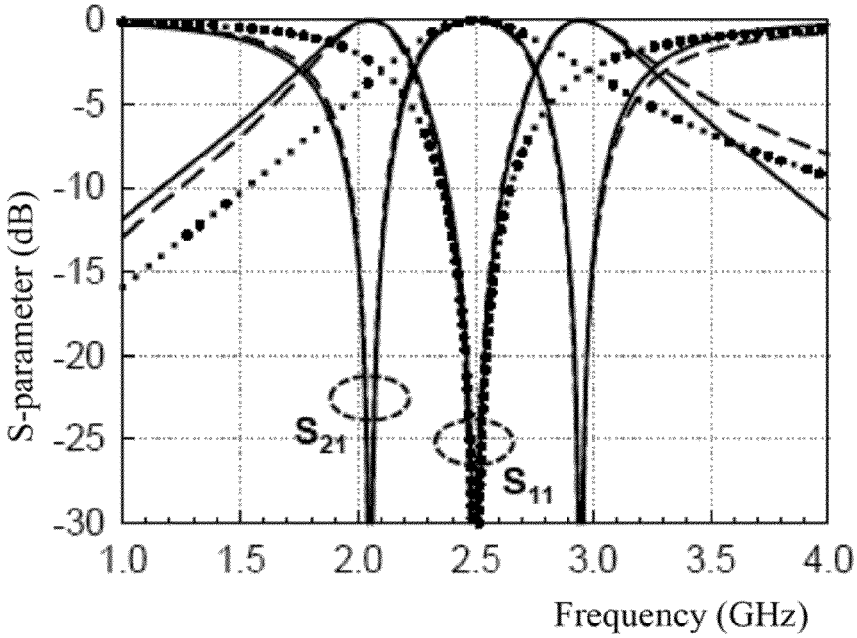
FIG. 3 is a diagram of simulation results of a geometrical structure and an equivalent circuit of a coupled line resonator in an embodiment of the present disclosure.

FIG. 3 is a diagram of simulation results of a geometrical structure and an equivalent circuit of the coupled line resonator 12 in an embodiment of the present disclosure. The x-axis in FIG. 3 represents the frequency (GHz) and the y-axis represents the S-parameter (dB). In the present embodiment, the widths of both of the open-circuited stub 20 and the short-circuited stub 22 are 0.5 mm. The width of the gap 24 is 0.2 mm. The open-circuited stub 20 and the to short-circuited stub 22 are formed on a substrate having a thickness of 0.508 mm, a dielectric constant of 3.38 and a loss tangent of 0.0027. The solid lines in FIG. 3 represent the simulation result of the coupled line resonator 12 depicted in FIG. 1A. The dashed lines in FIG. 3 represent the simulation result of the equivalent circuit depicted in FIG. 2B. The dotted lines in FIG. 3 represent the simulation result of the equivalent circuit depicted in FIG. 2C.

As shown in FIG. 3, the simulation results of the equivalent circuit depicted in FIG. 2B and the coupled line resonator 12 depicted in FIG. 1A are nearly identical. The simulation results of the equivalent circuit depicted in FIG. 2C and the coupled line resonator 12 depicted in FIG. 1A are also similar around the resonant frequency fr. The part labeled S11 in FIG. 3 indicate the curves of the reflection coefficient and the part labeled S12 in FIG. 3 indicate the curves of the refraction coefficient. The transmission pole generated at the resonant frequency fr is at about 2.5 GHz. The two symmetric transmission zeros at the band edge are generated approximately at 2.0 GHz and 3.0 GHz respectively.

Figure 4:
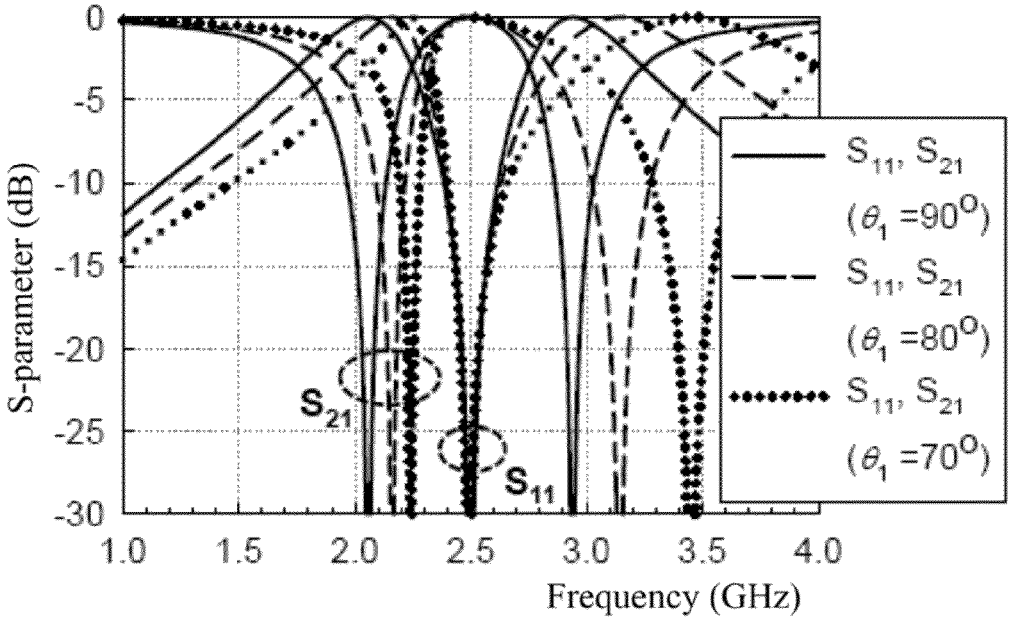
FIG. 4 is a diagram similar to FIG. 3, but illustrating simulation results when the length of the open-circuited stub is varied.

When the open-circuited stub 20 and the short-circuited stub 22 are designed to have unequal lengths as depicted in FIG. 1B, two asymmetric transmission zeros are generated at the band edge. FIG. 4 is a diagram similar to FIG. 3, but illustrating simulation results when the electric length of the short-circuited stub 22 is fixed at $\theta=\pi/2$ (at resonant frequency) and the length $\theta 1$ of the open-circuited stub 20 varies. As shown in FIG. 4, when $\theta 1$ gradually decreases, the resonant frequency (2.5 GHz) does not change but the location of the transmission zeros moves toward higher frequency. Hence, the length $\theta 1$ of the open-circuited stub 20 can be adjusted according to the demand of the position of the transmission zeros.

Figure 5A:
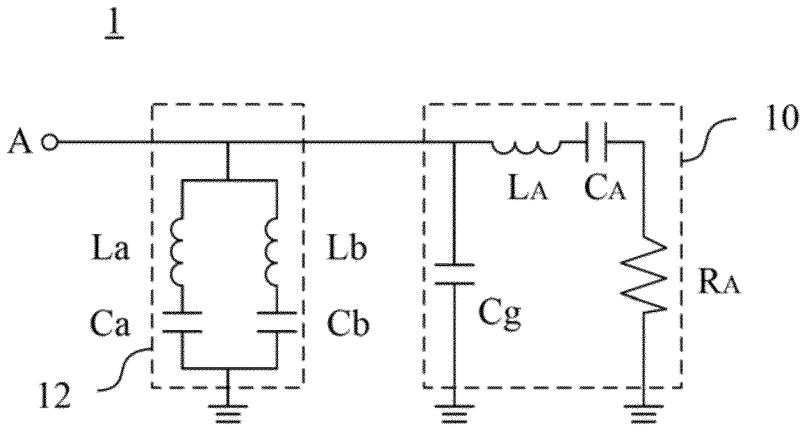
FIG. 5A to FIG. 5C are diagrams of equivalent circuits of the printed filtering antenna in an embodiment of the present disclosure.
Figure 5B:
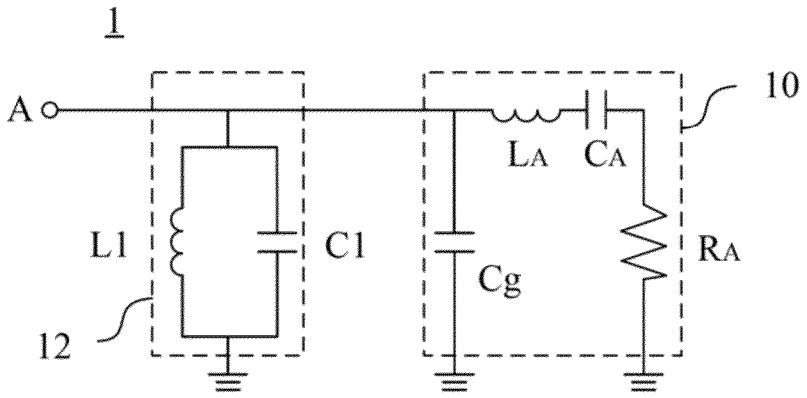
Figure 5C:
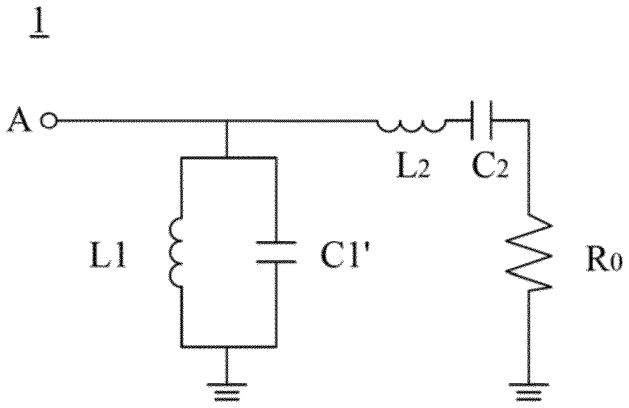

FIG. 5A to FIG. 5C are diagrams of equivalent circuits of the printed filtering antenna 1 comprising the antenna part 10 and the coupled line resonator 12 in an embodiment of the present disclosure. The coupled line resonator 12 in FIG. 5A is the same as the coupled line resonator 12 depicted in FIG. 2B and the coupled line resonator 12 in FIG. 5B is the same as the coupled line resonator 12 depicted in FIG. 2C. Hence, in addition to generating the frequency response of the second-order filtering antenna, the coupled line resonator 12 is able to generate two transmission zeros at the band edge. When the resonant frequency of the coupled line resonator 12 depicted is around fr, the printed filtering antenna 1 in FIG. 5A is transformed to the equivalent circuit depicted in FIG. 5B and is further transformed to the equivalent circuit depicted in FIG. 5C. The circuit depicted in FIG. 5C is an equivalent circuit of a typical second-order band-pass filter, where $L2=L_A$, $C2=C_A$, $R0=R_A$ and $C1'=C1+Cg$.

Figure 6:
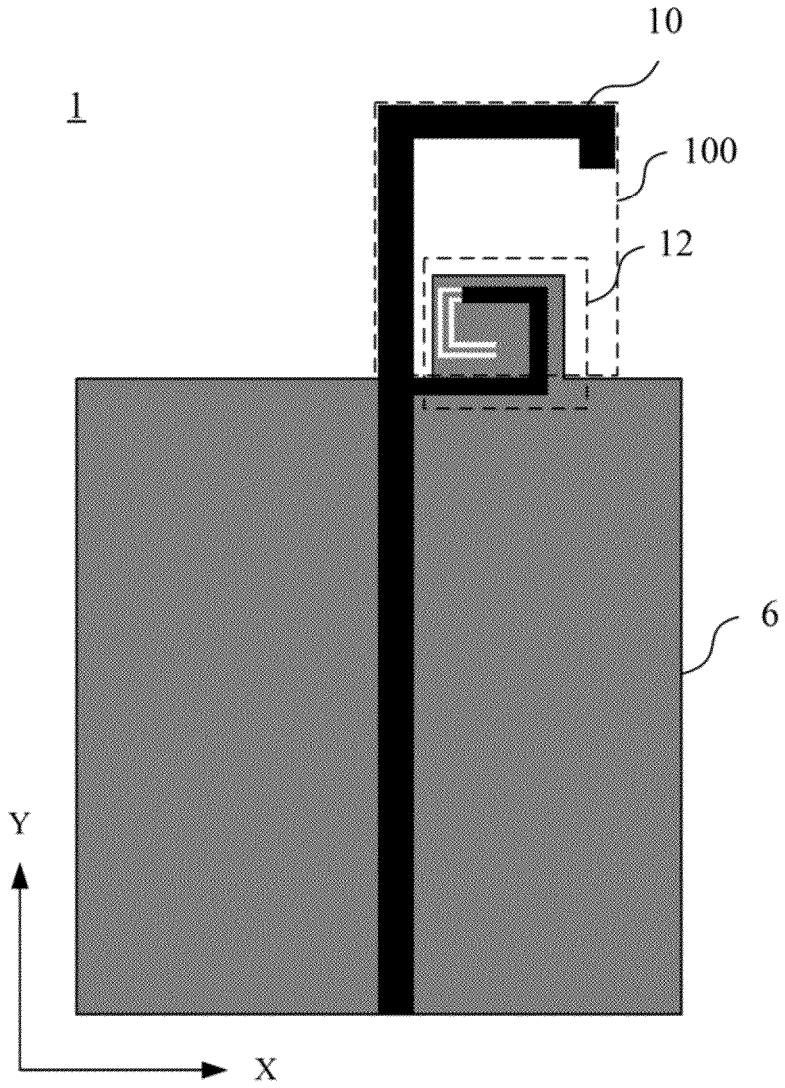
FIG. 6 is a top view of the printed filtering antenna of an embodiment of the present disclosure.
Figure 7:
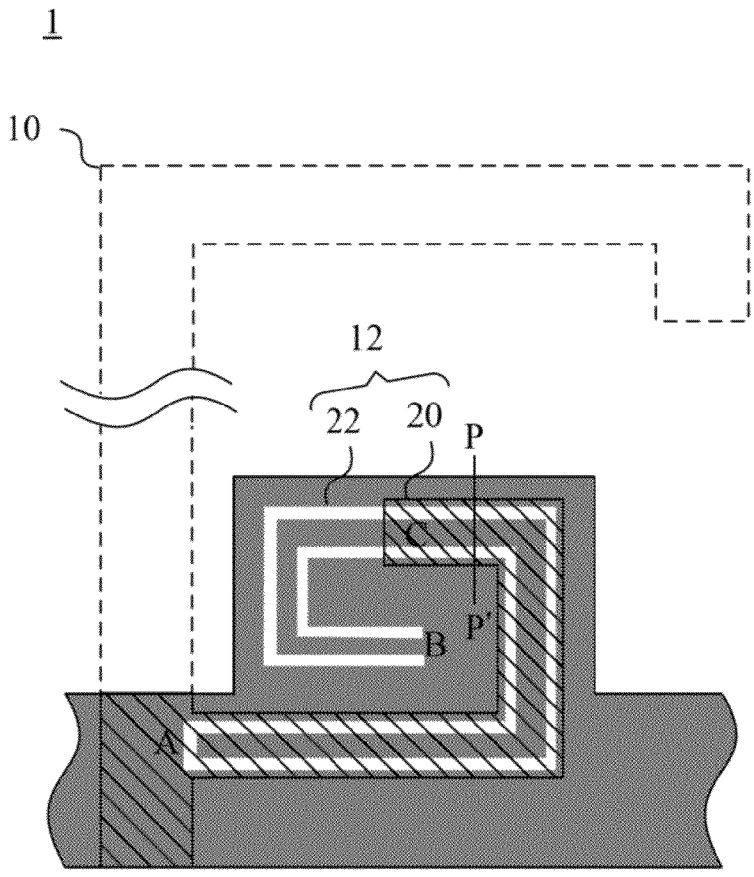
FIG. 7 is a partially enlarged view of the printed filtering antenna in FIG. 6.

FIG. 6 is a top view of the printed filtering antenna 1 of an embodiment of the present disclosure. FIG. 7 is a partially enlarged view of the printed filtering antenna 1 in FIG. 6. In the present embodiment, the antenna part 10 of the printed filtering antenna 1 is a Γ-shaped monopole antenna having an antenna area 100. Point A in FIG. 7 is the feed point of the antenna part 10.

Figure 8:
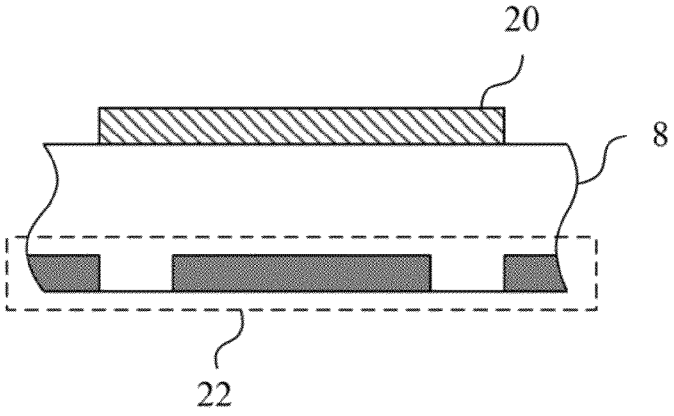
FIG. 8 is a cross-sectional view of the coupled line resonator in FIG. 7 taken along line P-P'.

The coupled line resonator 12 is formed in the antenna area 100 and is connected to the antenna part 10 to provide a filtering mechanism together with the antenna part 10. FIG. 8 is a cross-sectional view of the coupled line resonator 12 in FIG. 7 taken along line P-P'. In the present embodiment, the to open-circuited stub 20 is a micro strip and the short-circuited stub 22 is a coplanar waveguide (CPW). In the present embodiment, the printed filtering antenna 1 further comprises a substrate 8 disposed between the open-circuited stub 20 and the short-circuited stub 22 to form the gap 24 depicted in FIG. 1A. The black region depicted in FIG. 6 is the layout formed above the substrate 8 and the gray region is the layout formed under the substrate 8. In order to depict the structure of the open-circuited stub 20 and the short-circuited stub 22 clearly, the substrate is not shown in FIG. 6 and FIG. 7. Accordingly, the open-circuited stub 20 and the short-circuited stub 22 are formed on the opposite side of the substrate 8. In the present embodiment, the short-circuited stub 22 is an extension of a ground surface 6 (depicted in FIG. 6) under the substrate 8.

Hence, the open-circuited stub 20 and the short-circuited stub 22 can accomplish the filtering mechanism and provide a better selection of the band edge through the side coupling effect between the open-circuited stub 20 and the short-circuited stub 22. Further, the total area of the printed filtering antenna 1 does not increase since the coupled line resonator 12 is disposed in the antenna area 100. The small size of the printed filtering antenna 1 can be maintained.

Figure 9:
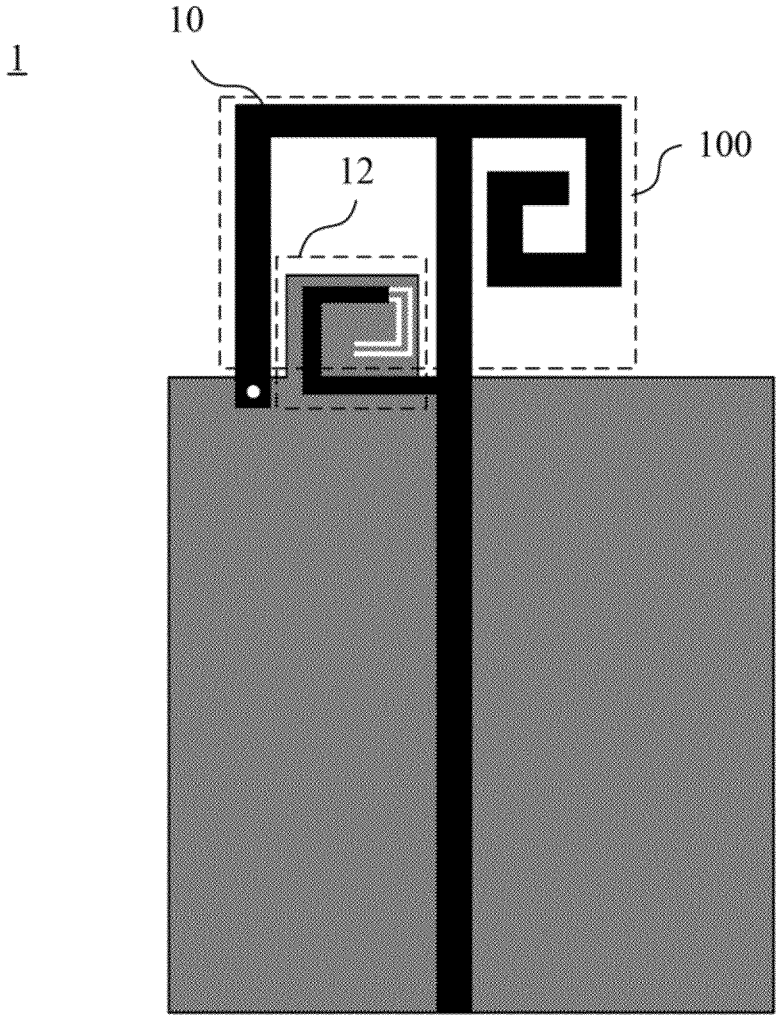
FIG. 9 and FIG. 10 are two top views of the printed filtering antenna of two embodiments of the present disclosure.
Figure 10:
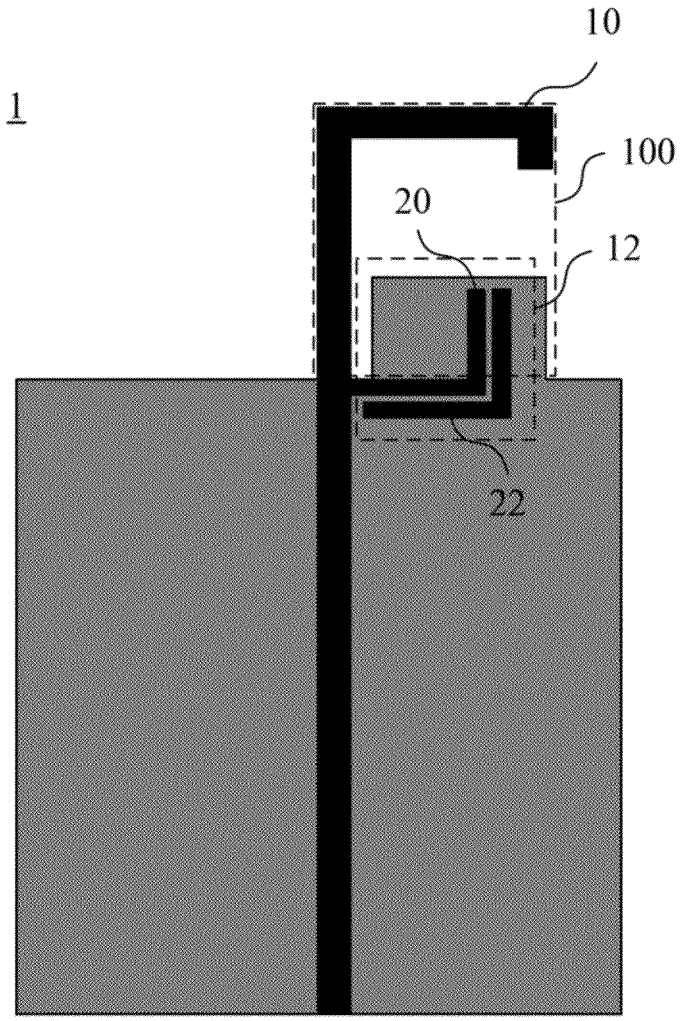

FIG. 9 and FIG. 10 are two top views of the printed filtering antenna 1 of two embodiments of the present disclosure. The antenna part 10 in FIG. 9 is an F antenna, in which the coupled line resonator 12 is disposed in the antenna area 100 occupied by the antenna part 10. On the other hand, the open-circuited stub 20 and the short-circuited stub 22 of the coupled line resonator 12 in FIG. 10 are both micro strips formed on the same plane, in which the two micro strips are separated by a gap to form the structure depicted in FIG. 1A. In other embodiments, the structure of slot line, coplanar stripline (CPS) or the transmission lines other then the micro strip and the CPW can also be used to form the open-circuited stub 20 and the short-circuited stub 22 of the coupled line resonator 12.

Figure 11A:
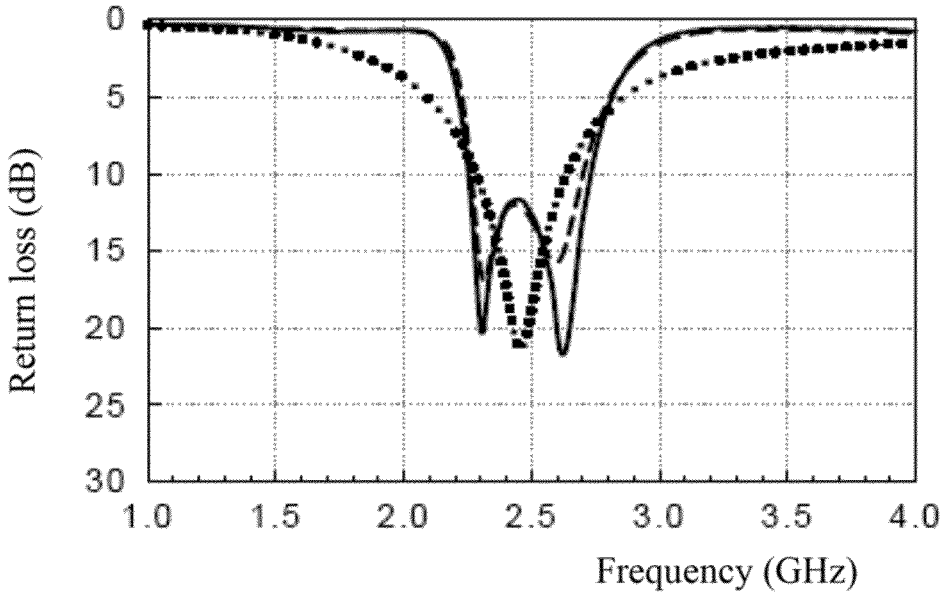
FIG. 11A is a diagram of the frequency response of the return loss of the printed filtering antenna of the present disclosure and of a conventional single Γ-shaped antenna.
Figure 11B:
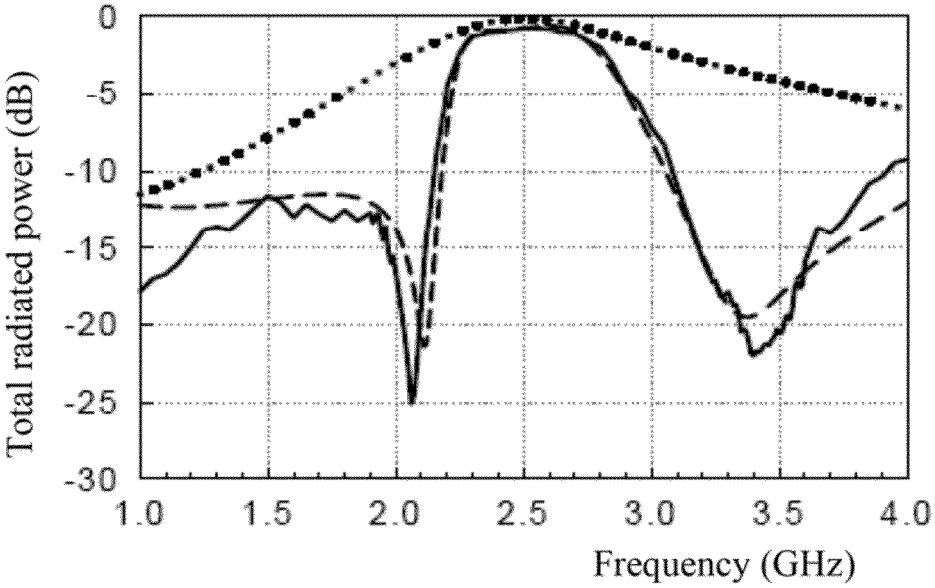
FIG. 11B is a diagram of the frequency response of the total radiated power of the printed filtering antenna of the present disclosure and of the conventional single Γ-shaped antenna.

FIG. 11A is a diagram of the frequency response of the return loss of the printed filtering antenna 1 of the present disclosure and of a conventional single Γ-shaped antenna. FIG. 11B is a diagram of the frequency response of the total radiated power of the printed filtering antenna 1 of the present disclosure and of the conventional single Γ-shaped antenna. The solid lines in FIG. 11A and FIG. 11B represent the measuring results of the printed filtering antenna 1 of the present disclosure. The dashed lines in FIG. 11A and FIG. 11B represent the simulation results of the printed filtering antenna 1 of the present disclosure. The dotted lines in FIG. 11A and FIG. 11B represent the simulation results of the conventional single Γ-shaped antenna. The simulation results of the printed filtering antenna 1 show that two poles are generated at 2.3 GHz and 2.6 GHz while two radiating zero points are generated at 2.11 GHz and 3.31 GHz. Moreover, the simulated radiating efficiency around the operation frequency 2.45 GHz is 82% and the simulated radiating efficiency around the two transmission zeros is 0.7% and 1.1% respectively. The simulation results match the measuring results of the printed filtering antenna. From FIG. 11A and FIG. 11B, it is clear that when compared to the conventional single Γ-shaped antenna having the same area, the printed filtering antenna of the present disclosure provides a smoother full-wave power response of the radiated power, a better selection of the band edge and a better rejection of the stop band.

Figure 12A:
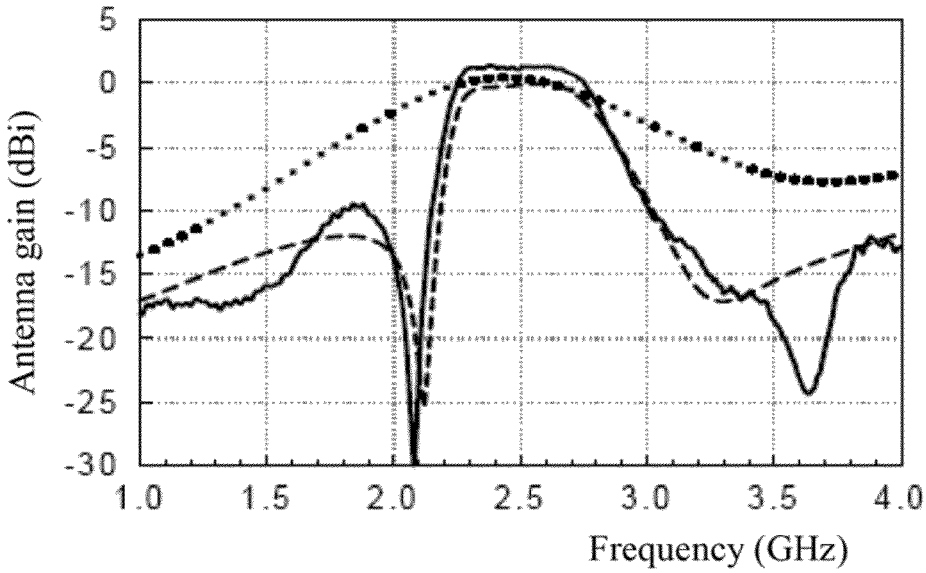
FIG. 12A and FIG. 12B are diagrams of the response of the antenna gain with respect to frequency along direction +z and direction +x of the printed filtering antenna of the present disclosure and the conventional single Γ-shaped antenna.
Figure 12B:
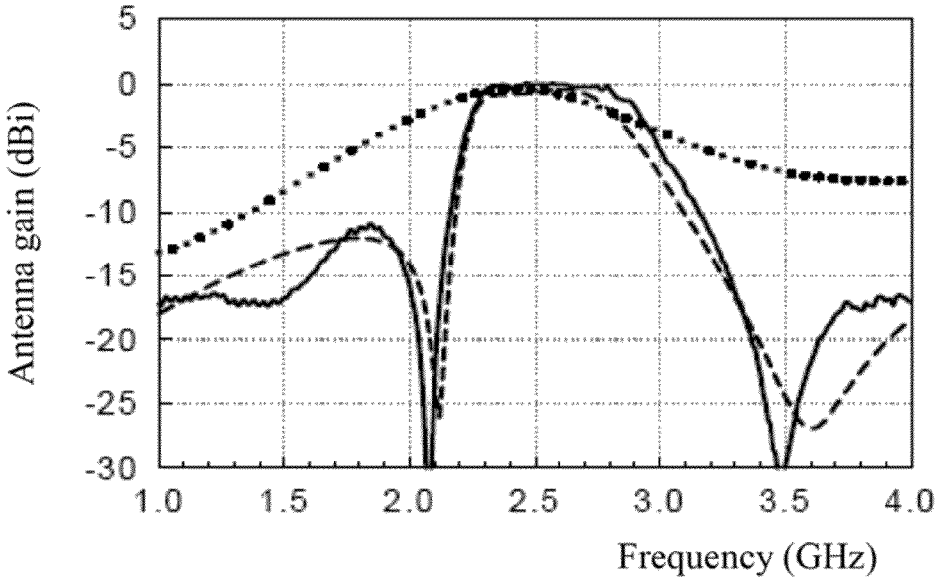

FIG. 12A and FIG. 12B are diagrams of the response of the antenna gain with respect to frequency along direction +z and direction +x of the printed filtering antenna 1 of the present disclosure and the conventional single Γ-shaped antenna, in which the actual direction of the directions x and y are depicted in FIG. 6 and the actual direction of the direction z is the direction pointing out of the paper. The solid lines in FIG. 12A and FIG. 12B represent the measuring results of the printed filtering antenna 1 of the present disclosure. The dashed lines in FIG. 12A and FIG. 12B represent the simulation results of the printed filtering antenna 1 of the present disclosure. The dotted lines in FIG. 12A and FIG. 12B represent the simulation results of the conventional single Γ-shaped antenna. From FIG. 12A and FIG. 12B, it is clear that when compared to the conventional single Γ-shaped antenna having the same area, the printed filtering antenna of the present disclosure provides a smoother response of the full-wave power radiation, a better selection of the band edge and a better rejection of the stop band.

Figure 13A:
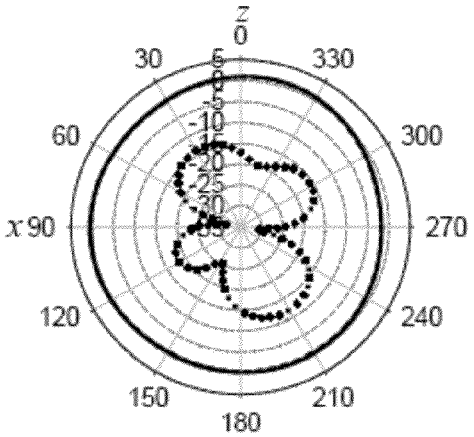
FIG. 13A to FIG. 13C are diagrams of measuring results of antenna radiation patterns on the x-z, y-z and x-y planes respectively.
Figure 13B:
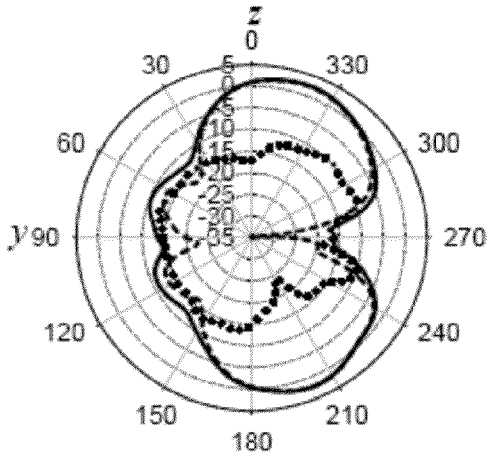
Figure 13C:
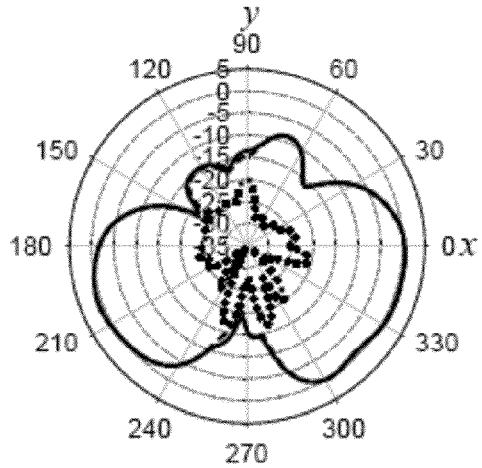

FIG. 13A to FIG. 13C are diagrams of measuring results of the antenna radiation pattern on the x-z plane, y-z plane and x-y plane respectively when the printed filtering antenna 1 is at a central frequency of 2.45 GHz. On the x-z plane, the antenna radiation pattern is omni-directional. The maximum of the antenna gain is 1.2 dBi. From FIG. 13A to FIG. 13C, it is clear that when compared to the conventional single Γ-shaped antenna having the same area, the printed filtering antenna 1 of the present disclosure maintains better consistency.

Figure 14:
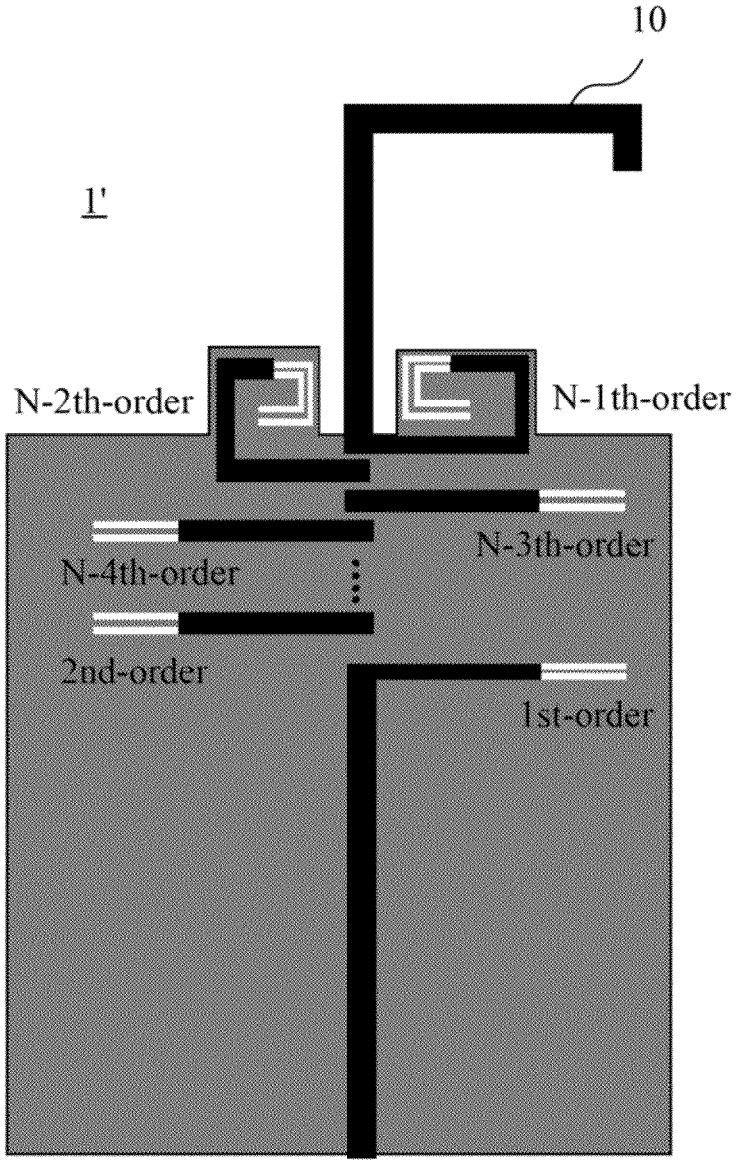
FIG. 14 is a top view of an Nth-order printed filtering antenna in an embodiment of the present disclosure.

In the previous embodiments, the order of the coupled line resonator is one and the printed filtering antenna is a second-order filtering antenna. However, the printed filtering antenna can be expanded to an Nth-order. FIG. 14 is a top view of a printed filtering antenna 1' in an embodiment of the present disclosure. In the present embodiment, the order of the coupled line resonator is N-1 such that the printed filtering antenna 1' becomes an Nth order filtering antenna. Each order of the coupled line resonator is coupled to each other and only one order of the coupled line resonator (the N-1th order in the present is embodiment) is connected to the antenna part 10 directly.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A printed filtering antenna, comprising:

an antenna part; and a coupled line resonator connected to the antenna part to provide a filtering mechanism together with the antenna part, wherein the coupled line resonator comprises:

a short-circuited stub comprising an open-circuited end and a short-circuited end connected to ground; and an open-circuited stub parallel to the short-circuited stub wherein a gap is formed between the open-circuited stub and the short-circuited stub, and the open-circuited stub comprises a first end and a second end in which the first end is connected to the antenna part and is corresponding to the open-circuited end of the short-circuited stub such that the open-circuited stub is coupled to the short-circuited stub.

2. The printed filtering antenna of claim 1, wherein an equivalent circuit of the short-circuited stub and the open-circuited stub comprises two groups of series-connected inductor-capacitor (LC) resonators that are connected in parallel.

3. The printed filtering antenna of claim 2, wherein the two groups of series-connected LC resonators generate two transmission zeros at a band edge of the printed filtering antenna.

4. The printed filtering antenna of claim 3, wherein the two groups of series-connected LC resonators are equivalent to a single parallel-connected LC resonator at a resonant frequency of the printed filtering antenna to generate a transmission pole.

5. The printed filtering antenna of claim 4, wherein when a first electric length of the open-circuited stub and a second electric length of the short-circuited stub are equal to $\pi/2$ at the resonant frequency or each of the open-circuited stub and the short-circuited stub is a quarter-wavelength circuit, and the two transmission zeros are symmetric with respect to the transmission pole.

6. The printed filtering antenna of claim 4, wherein when a first electric length of the open-circuited stub and a second electric length of the short-circuited stub are not equal, the two transmission zeros are asymmetric with respect to the transmission pole.

7. The printed filtering antenna of claim 1, wherein the short-circuited stub and the open-circuited stub are two micro-strips disposed on the same plane.

8. The printed filtering antenna of claim 1, wherein the short-circuited stub is a coplanar waveguide (CPW) and the open-circuited stub is a micro-strip, and a substrate is formed in the gap between the short-circuited stub and the open-circuited stub such that the short-circuited stub and the open-circuited stub are on opposite sides of the substrate.

9. The printed filtering antenna of claim 8, wherein the short-circuited stub is an extension of a ground surface.

10. The printed filtering antenna of claim 1, wherein the short-circuited stub and the open-circuited stub are a slot line or a coplanar stripline (CPS) respectively.

11. The printed filtering antenna of claim 1, wherein the antenna part occupies an antenna area and the coupled line resonator is formed in the antenna area.

12. The printed filtering antenna of claim 1, wherein the antenna part is a monopole antenna, an F antenna or an inverted-F antenna.

13. The printed filtering antenna of claim 1, wherein the coupled line resonator has an N-1 order such that the antenna part is an Nth-order antenna, in which each order of the coupled line resonator is coupled to each other and one order of the coupled line resonator is connected to the antenna part directly.

* * * * *